US006886384B2

(12) United States Patent
Gray

(10) Patent No.: US 6,886,384 B2
(45) Date of Patent: May 3, 2005

(54) PROCESS FOR FORMING A THREADED MEMBER

(76) Inventor: Peter Andrew Gray, 11 Partridge Place, Figtree, NSW 2525 (AU)

( * ) Notice: Subject to any disclaimer, the term of this patent is extended or adjusted under 35 U.S.C. 154(b) by 0 days.

(21) Appl. No.: 10/332,329

(22) PCT Filed: Mar. 15, 2001

(86) PCT No.: PCT/AU01/00286

§ 371 (c)(1),
(2), (4) Date: Jan. 7, 2003

(87) PCT Pub. No.: WO01/68287

PCT Pub. Date: Sep. 20, 2001

(65) Prior Publication Data

US 2004/0025557 A1 Feb. 12, 2004

(30) Foreign Application Priority Data

Mar. 15, 2000 (AU) ..... PQ6246

(51) Int. Cl.[7] ..... B21H 3/04

(52) U.S. Cl. ..... 72/103; 470/10; 470/11; 405/259.1

(58) Field of Search ..... 72/88, 103, 104; 470/10, 11; 405/259.1; 411/411, 415, 423; 52/740.3, 740.4, 740.5

(56) References Cited

U.S. PATENT DOCUMENTS

| | | | | | |
|---|---|---|---|---|---|
| 3,782,839 | A | * | 1/1974 | Majewski | 403/43 |
| 4,056,911 | A | * | 11/1977 | Tani | 52/740.3 |
| 4,092,814 | A | | 6/1978 | Kern | |
| 4,137,686 | A | | 2/1979 | Kern | |
| 4,229,501 | A | | 10/1980 | Kern | |
| 4,584,247 | A | * | 4/1986 | Mulholland | 428/592 |
| 4,811,541 | A | | 3/1989 | Finsterwalder | |
| 4,856,952 | A | * | 8/1989 | Shaw | 411/413 |
| 4,861,197 | A | * | 8/1989 | Calandra, Jr. | 405/259.3 |
| 4,922,681 | A | | 5/1990 | Russwurm et al. | |
| 4,953,379 | A | | 9/1990 | Richartz | |
| 5,775,850 | A | * | 7/1998 | Gale et al. | 405/259.5 |

FOREIGN PATENT DOCUMENTS

| | | |
|---|---|---|
| AU | 199738308 B2 | 3/1998 |
| DE | 1 813 627 | 6/1970 |
| DE | 27 30 001 A1 | 1/1979 |
| WO | WO 95/05525 | 2/1995 |
| WO | WO 99/20856 | 4/1999 |

* cited by examiner

*Primary Examiner*—Ed Tolan
(74) *Attorney, Agent, or Firm*—Teresa J. Welch; Jeffrey D. Peterson; Michael Best & Friedrich LLP

(57) ABSTRACT

A process for the formation of a thread form in a substantially elongate member (1), wherein the thread form includes at least one rib (3) spaced apart from at least one other rib along the elongate member and wherein the thread form has a relatively coarse rib spacing but a fine thread pitch.

11 Claims, 5 Drawing Sheets

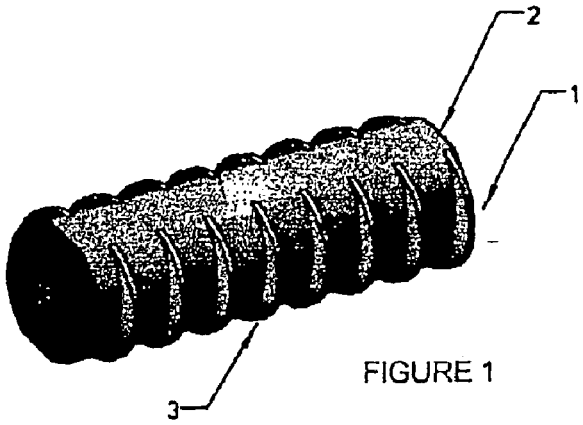
FIGURE 1
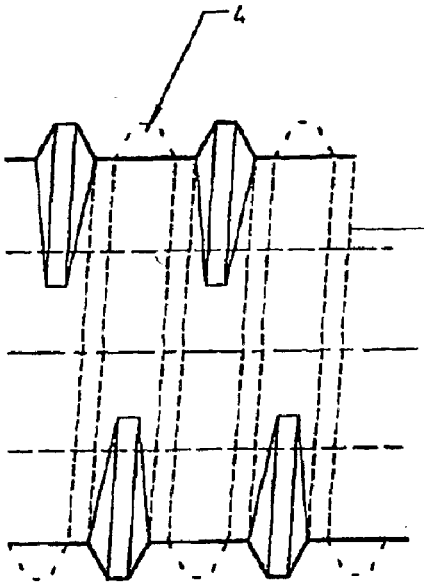
FIGURE 3
FIGURE 2
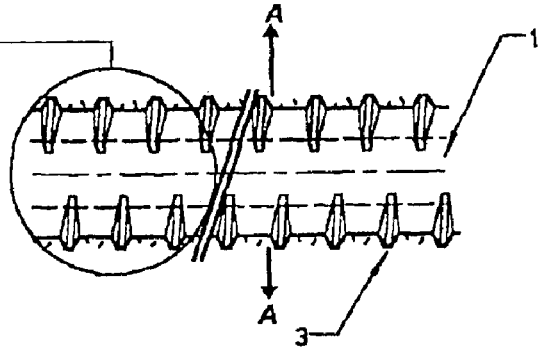
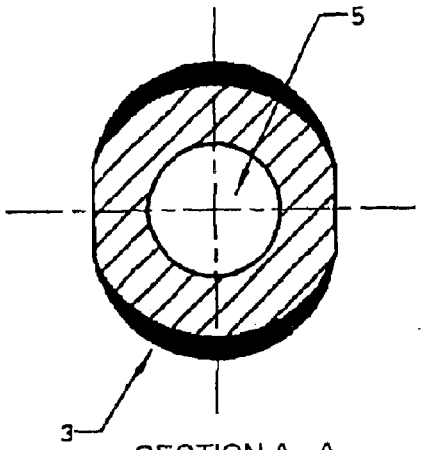
SECTION A - A
FIGURE 4
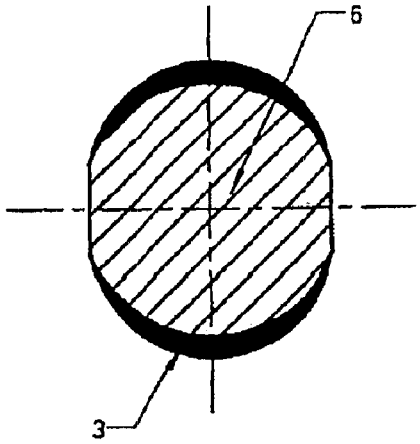
SECTION A - A
FIGURE 5

1
3
5
6
B
C
D

PROCESS FOR FORMING A THREADED MEMBER

This application is a 35 USC 371 of PCT/AU01/00286 filed Mar. 15, 2001.

FIELD OF THE INVENTION

The present invention relates, in general terms, to a process for the formation of a thread in a substantially elongate member, as for example, a bar, a bolt or a tie rod. More particularly, but not exclusively, the present invention relates to a thread formed by a hot rolling procedure, which thread form has a coarse rib spacing but with a fine thread pitch. The process in accordance with the present invention therefore results in the production of a thread form which exhibits the mechanical advantages associated with thread formed with cold rolled thread forming procedures, yet the process itself exhibits the manufacturing efficiency associated with hot rolling thread forming procedures.

BACKGROUND TO THE INVENTION

Thread rolling is a principal activity of bolt and nut manufacture. Most commonly, thread rolling is achieved by forcing at least two dies into a bar having a smooth surface and, by causing rotation of that bar with respect to the dies, metal is displaced to create a thread form on or in the bar itself. The dies employed in such procedures are typically made from hardened steel and have a suitable thread form machined into them such that, as they are forced into the bar, metal is displaced to create the desired thread form in the bar itself. The dies are typically either circular or flat. Circular dies usually have either two or three circular dies arranged such that there is a space between the dies to allow the bar to pass therethrough. This thread rolling process is known as "through rolling", since the thread form is progressively formed as the bar passes through or across the dies themselves. If the thread rolling process utilises flat dies, such these are usually used in pairs with each die typically being of the order of 150 mm wide, and being spaced apart to allow the bar to pass through the gap existing therebetween. The flat dies press into the bar over the whole width of the die. This process is known as "plunge rolling". Plunge rolling is a faster process than through rolling. However, both plunge rolling and through rolling are collectively known as "Cold Rolling of Threads".

Cold rolling of threads necessitates the displacement and flow of metal. Some metal is displaced away from the points of the dies, and some metal is displaced upwards to form the new high points of the thread on the bar. This cold rolling and displacement of metal causes the metal in the thread to become harder. Hence, cold rolled threads are normally stronger than machined threads. This process of the steel or the like material becoming harder is known as "Cold Working".

However, cold working of steel can also cause the metal, and in particular some grades of steel, to become brittle. Cracking can occur at the root or base of the formed thread. This can lead to a weakness in the formed thread and be a source of premature thread failure. For example, where the threaded section of a rock bolt protrudes from the roof of a mine or tunnel, it can be subject to damage through being hit by heavy machinery passing along the roadway. If the threaded section is brittle, premature failure of the rock bolt can occur.

Cold rolling of threads can normally only be performed on bars, having a smooth surface, or the like members.

Therefore, bars with deformations on them require that the deformations be removed before a thread rolling process can be undertaken. By way of example only, rock bolts produced from hot rolled bars with deformations on them could typically have a core dimension of 21.7 mm, having a maximum diameter across the deformations of 24 mm. These deformations could be removed either by bar peeling or by swaging prior to thread rolling, such that a bar, having a smooth surface, with a diameter of, for example, 21.6 mm, would be produced. A thread could then be cold rolled onto such a bar and, in this case, it would typically be an M24 thread (i.e. a metric 24 mm thread).

An M24 thread has a pitch of 3 mm. That is, one revolution around the thread causes axial movement along the axis of the bar of 3 mm. The pitch of the thread determines its mechanical advantage and the angle that the threads form with the longitudinal axis of the bar. A 3 mm thread pitch provides excellent mechanical advantage for rock bolts and a tensile load of between 2 and 10 tonnes can be generated in such rock bolts, depending on the torque applied by the drilling machine being employed.

A very fine thread provides even greater mechanical advantage, but is more susceptible to thread damage. This is especially the case for rock bolts and concrete tie rods, which are used in rugged environments. Conversely, coarse threads are less susceptible to damage but provide poor mechanical advantage.

Threads may can also be formed on bars using what is known as a hot rolling process. As a bar is being formed in a hot rolling mill, synchronised rolls can be used to press a thread form into opposite sides of a bar. The ribs which are so formed protrude from the bar and typically form a discontinuous thread around and along the bar. Some advantages associated with a hot rolled thread include:

- the thread is not affected by cold working;
- the tensile strength and elongation characteristics of the bar are uniform all the way along the bar, unlike cold rolled threaded bars where the root diameter of the threaded section is the weakest part of the bar;
- the bar and the thread are less susceptible to damage because the thread itself is coarse;
- the thread ribs are an integral part of the bar and are less likely to be affected by cracking occurring at the base of the ribs;
- threads can be formed in materials, particularly high tensile strength steels, that would be unsuitable for thread cold rolling;
- the process of the hot rolling of threads is very fast and economical and does not require a secondary processing operation, unlike cold thread roiling procedures which require bar peeling or swaging in addition to cold thread rolling.

However, a disadvantage is that hot rolled threads are usually very coarse. For example, hot rolled threads would typically have a 10 mm or greater pitch dependent upon bar diameter. The main reason for having a coarse hot rolled thread is that, although a fine thread form could be machined into the rolls used in a hot rolling mill, such a fine thread form would wear out very quickly. The fine machining and sharp points required in a roll to form a fine thread would wear or break as the hot bar passed through the rolls at the speeds normally employed, which may be up to, for example, 10 meters per second.

For this reason, the thread ribs also tend to be wide and have a "flat" crest to the thread form typically 1 mm wide or greater. This coarse thread on hot rolled threads has the advantage of making the thread very robust and less susceptible to damage, but on the other hand provides poor mechanical advantage and makes it difficult to apply high tensile loads in bars and bolts thus formed. Typically, hot rolled threaded bars which have diameters of 26.5 mm, 32 mm and 36 mm, respectively, have pitches of 13 mm, 16 mm and 18 mm, respectively.

A hot rolling process involves passing a billet of hot steel through a series of rolling stands to progressively reduce the size of the billet down to the desired diameter for of the final product. Typically, billets may be from 90 mm×90 mm up to 150 mm×150 mm and up to 12 m long, which are heated up to approximately from 900 to 1100° C. and are then passed through a series of rolls (normally between 10 and 20 pairs of rolls) to progressively reduce the diameter of the billet. As the billet reduces in diameter it increases in length, and hence its speed through the mill also increases. Typically, a billet would enter the first rolling stand at a slow speed of, for example say, 0.5 meters per second and, by the time it has passed through the last rolling stand, it could be travelling at, for example say, 10 meters per second. Such a hot rolling procedure is a very fast and efficient method of manufacture for a wide range of bars and sections.

In the case of rock bolts, the hot rolled thread is formed on the bar in the last rolling stand. Ribs are machined into the rolls as "grooves" in the rolls such that, as the bar is squeezed by the rolls, a male rib would be formed on the bar. Multiple grooves are machined into the top and bottom rolls and each roll is synchronised with the other of each mating pair, such that a thread form is produced on the hot rolled bar. For hot rolled bars produced using presently known technologies, these grooves are spaced and angled to the axis of the bar, such that they form a coarse pitched threaded bar.

It is an object of the present invention to provide a process for the formation of a thread form that has all the advantages of a hot rolled thread, but has a similar pitch to a cold rolled thread, such that it exhibits the mechanical advantages associated with both a hot rolled thread and a cold rolled thread. The process of the present invention seeks to provide a hot rolled threaded member having a relatively fine-pitched thread.

In a typical rock bolt application, the present invention can produce a bar that is simply cut to length and then only a suitable nut and domed ball needs to be attached to the bar to produce a finished rock bolt. No additional post-rolling manufacturing is required.

An additional significant advantage of the process of the present invention is that it allows multiple hot rolled threaded bars to be joined together, using one or many couplers, depending upon the number of bars to be joined together.

For a conventional coupled bar or coupled rock bolt arrangement, the ends of two threaded bars may be screwed into each end of a female threaded coupler. The coupler is of sufficient length to engage enough threads on the bar, and is designed to be stronger in tension than the tensile strength of the bar such that when two bars are each screwed firmly into the coupler, the coupled joint of the two bars is stronger than the solid bar itself. By using multiple couplers, it is possible to form a very long solid bar and this has significant applications in underground mining and tunneling applications.

This form of coupled bar or coupled rock bolt is well known prior art and is used where long bolts are required for geotechnical or other reasons. However, where long bolts are required, cables bolts are normally used rather than coupled solid bars. This is primarily for two reasons.

Firstly, cables are made from much higher tensile strength steel than solid bolts (typically 1500 MPa for cables compared to 800 MPa for solid bolts for their respective ultimate tensile strengths) and this enables cables to be produced with both high tensile strength (typically 50 to 75 tonnes for mining applications) and reasonable weight (typically less than 5 kgs per meter).

Secondly, it is possible to make very long cables, which can be bent to fit into confined spaces in underground tunnels and mines and still be installed to provide long bolt support.

Conventionally, coupled solid bolts can compete with long cables bolts but, to obtain the same high tensile strength as cables, it is necessary to use a larger diameter solid bar. This means that a different and larger diameter solid bar must be produced to be used as a coupled bolt to compete with cables. This requires an additional product to be made by the steel mill to make a large diameter bar for coupled bolt applications only and this will not be as common as smaller diameter solid bars used for general rock bolting applications.

The weight of a larger diameter solid bar for a coupled bolt is not usually a problem, since drilling machines can easily push multiple solid coupled bars up a hole. The fact that solid coupled bars can be pushed is a major advantage and drilling machines can easily push them up holes and through multiple resin cartridges, which is more difficult to do with a flexible cable or cable bolt.

The other major advantage of solid coupled bars is that that they can be produced with a hot rolled ribbed external profile and this can provide a high bond strength with resin or grout. This is known as a rock bolt's load transfer capacity and the higher the load transfer capacity, the more effectively the rock bolt will support the tunnel or mine roadway. Cables cannot provide such a high load transfer capacity as hot rolled ribbed bars or bolts.

For conventional solid coupled bolts, the top of the coupled bolts at the top of the hole is anchored either by resin or by a mechanical anchor and the rest of the coupled bolts can be grouted either with cement, resin or a polyurethane resin (PUR). The grout is normally pumped up from the bottom collar of the hole and flows up around the bolts and around the couplers. Alternatively, a grout tube can be used where the grout is pumped up the tube to the top of the hole and fills up the cavity between the bolt and the hole with grout.

Whether a grout tube is used or not used with a conventional coupled bolt, there must be sufficient clearance left between the outside diameter of the coupler and the diameter of the hole to allow grout to flow easily around the coupler and fill up the cavity between the bolt and the hole. This necessitates the use of a larger diameter hole than is necessary just to fit the coupler up the hole. The problem is further exacerbated if, for example, a 20 mm diameter grout tube has to fit around the outside of the coupler.

Conventional coupled bolts, therefore, have the following disadvantages. They require the use of larger diameter bar than standard rock bolts in order to generate similar tensile capacity as cables. They also require the use of couplers, where there must be sufficient clearance between the outside of the coupler and the borehole wall to allow grout and or a grout tube to pass around the coupler.

The new thread form of the present invention further allows a new coupled rock bolt or coupled bar to be used in a manner as described hereinafter in more detail.

It should be noted that the couplers and assembled bars described can be used when any threaded bar according to the present invention is joined to another bar, for example in concrete reinforcing bars, foundation tie down bolts, formwork tie bars and small diameter flexible bars making up a larger assembled bolt. However, the present invention is not so limited.

The invention herein is described with particular reference to the manufacture of rock bolts, but it should be understood that the invention is not to be considered to be limited in any way to any particular or preferred embodiment or embodiments described. Rather, the present invention could be equally applied to any threaded elongate member. The invention is particularly, but not exclusively, applicable to hot rolled threaded bars but is not so limited.

SUMMARY OF THE INVENTION

In accordance with one aspect of the present invention, there is provided a process for the formation of a thread form in a substantially elongate member, wherein said thread form includes at least one rib spaced apart from at least one other rib along said elongate member, wherein said thread form has a relatively coarse rib spacing but a fine thread pitch. Preferably, the process for forming the thread is a hot rolling process.

Preferably, the at least one rib forms discontinuous segments of a continuous thread profile. More preferably, the ribs on each side of the elongate member are offset from each other by at least one thread pitch and are therefore located opposite to the core of the elongate member rather than to the at least one other rib. More preferably, the spacing apart of the ribs along the length of the elongate member is at least two thread pitches and less than five thread pitches.

Preferably, the pitch of the thread is close to the width of the base of the rib. More preferably, the base of the rib has a small radius where it joins the core of the bar. Preferably, the sides of the rib extending away from the core of the elongate member are inclined at an angle of approximately 60 degrees to the longitudinal axis of the core.

Preferably, the metal used to form a hot rolled threaded elongate member in accordance with the present invention is designed to provide maximum strength and elongation characteristics. More particularly, hot rolled threaded elongate members can be made from high tensile steel. Such high tensile steel bars may be unsuitable for cold thread rolling, because cold working of the bar may cause excessive embrittlement and cracking at the root of the threads formed therein. In addition, such high tensile steel bars may have undergone a quenching process to increase strength and surface hardness. Steel bars that have been so quenched are often unsuitable for cold thread rolling. However, since bar peeling and cold thread rolling are not required for hot roll threaded bars, the tensile strength and surface hardness of the bar are not limiting factors.

Preferably, the rib profiles are designed to provide maximum load transfer capacity when encapsulated in grout or resin. Bar rib profiles designed to provide maximum load transfer capacity require large ribs, spaced at approximately twice the rib width along the bar, and angled at an acute angle across the bar. This is not currently the case with most hot rolled bars used in the manufacture of rock bolts.

Preferably, the rib profiles are designed to provide a thread form which is suited to have a nut or the like member having at least one groove adapted to be easily screwed onto it. Since hot rolled threads are more susceptible to slight variations in pitch and rib height than cold rolled threads, the thread form and rib design used in the present invention are able to accommodate these slight variations.

Preferably, the rib profiles are designed to provide a thread form which enables a nut or the like member of minimum length to be used to generate adequate tensile capacity in the elongate member. In a preferred embodiment, the ribs on the elongate member may be spaced at 10 mm apart and the at least one groove in the nut or like member may be spaced apart from at least one other groove by 5 mm.

Preferably, two or more elongate members with a thread form in accordance with of the present invention can be assembled together such that their long axes are parallel and are aligned such that the outer ribs on the assembled bars form discontinuous segments of a thread spiral or helix about a cylinder enclosing the assembled elongate members.

Preferably, the hot rolled threaded elongate member profile is made from steel.

Preferably, the hot rolled threaded elongate member profile is used on rock bolts, coupled bolts and concrete formwork tie rods.

Preferably, the hot rolled threaded elongate member profile is used on both solid elongate members and on hollow elongate members.

The invention also relates to a threaded member when produced by the aforementioned process of the present invention.

In accordance with the present invention, therefore, there is also provided an elongate member including a thread form therein and extending along at least part of the length dimension thereof, wherein said thread form includes at least one rib spaced apart from at least one other, rib along said elongate member, wherein said thread form has a relatively coarse rib spacing but a fine thread pitch.

DESCRIPTION OF THE DRAWINGS

In order that the invention may be more clearly understood and put into practical effect, there shall now be described in detail a preferred embodiment of the process in accordance with the invention. The ensuing description is given by way of non-limitative example only and is with reference to the accompanying drawings, wherein:

FIG. 1 is a perspective view of a hot rolled threaded member in accordance with the present invention;

FIG. 2 is an enlarged side view of the thread detail of a hot rolled threaded member in accordance with the present-invention;

FIG. 3 is an enlarged view of the thread detail of FIG. 2 of the hot rolled threaded member of FIG. 1;

FIG. 4 is a cross section through section A—A of a hollow core of a hot rolled threaded member in accordance with the present invention;

FIG. 5 is a cross section through section A—A of a solid core of a hot rolled threaded member in accordance with the present invention;

FIG. 15 also shows that the rib spacing on the two assembled members is twice the pitch; FIG. 15 further shows a section through a coupler or a nut as viewed from section F—F in FIG. 16;

FIG. 18 further shows a section though a nut as viewed from section H—H in FIG. 19.

DETAILED DESCRIPTION OF THE PREFERRED EMBODIMENT OF THE INVENTION

Figures 6, 7, 8, 9, 10, 11, 12, 13, 14:
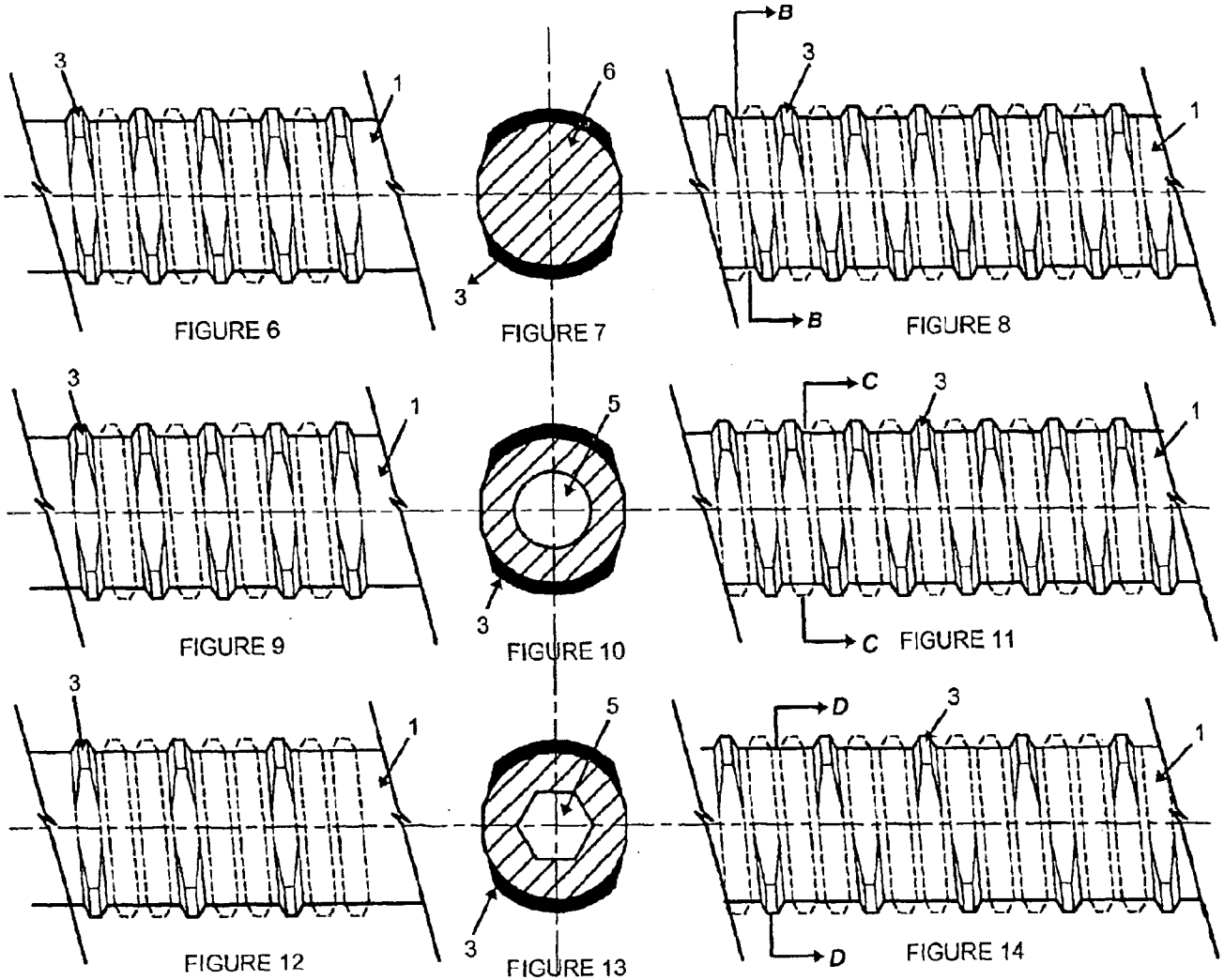
FIG. 6 is an enlarged side view of the thread detail of a hot rolled threaded member in accordance with the present invention where the rib spacing is twice the pitch as viewed from one side of the threaded member.
FIG. 7 is a cross-section through section B—B of a solid core of a hot rolled threaded member in accordance with the present invention, showing ribs at relatively constant height over their full length.
FIG. 8 is an enlarged side view of the thread detail of a hot rolled threaded member in accordance with the present invention, where the rib spacing is twice the pitch, as viewed from the opposite side of the threaded member to as that shown in FIG. 6.
FIG. 9 is an enlarged side view of the thread detail of a hot rolled threaded member in accordance with the present invention, where the rib spacing is twice the pitch, as viewed from one side of the threaded member.
FIG. 10 is a cross-section through section C—C of a hollow hot rolled threaded member with a circular central hole in accordance with the present invention, showing ribs at relatively constant height over their full length.
FIG. 11 is an enlarged side view of the thread detail of a hot rolled threaded member in accordance with the present invention, where the rib spacing is twice the pitch, as viewed from the opposite side of the threaded member to as that shown in FIG. 9.
FIG. 12 is an enlarged side view of the thread detail of a hot rolled threaded member in accordance with the present invention, where the rib spacing is three times the pitch, as viewed from one side of the threaded member.
FIG. 13 is a cross-section through section D—D of a hollow hot rolled threaded member with a hexagonal central hole in accordance with the present invention, showing ribs at relatively constant height over their full length.
FIG. 14 is an enlarged side view of the thread detail of a hot rolled threaded member in accordance with the present invention, where the rib spacing is three times the pitch, as viewed from the opposite side of the threaded member to as that shown in FIG. 12.

In the drawings, the same numerals have been used to designate similar integers in each Figure to avoid duplication of description.

The hot rolled threaded elongate member (1) in accordance with of the present invention includes a generally round core section (2) with a series of ribs (3) extending away from the core section (2). The ribs (3) are formed from the same material as the core section (2). The core section (2) may be a hollow core (5), as shown in FIGS. 3, 4, 10 and 13, or a solid core (6) as shown in FIGS. 5 and 7.

The ribs (3) form discontinuous segments of a continuous thread form (4), and are located around the circumference of the core section (2). The ribs (3) are located on opposite sides of the core section (2). The ribs (3) have their maximum height at the centre of each rib and may taper down to a reduced height at the sides of the core section (2) as shown in FIGS. 4 and 5 or may have a relatively uniform height over most of their length, as shown in FIGS. 7, 10 and 13.

The ribs (3) are preferably spaced along the bar (1) in an axial direction at intervals of at least two thread pitches. The thread pitch is preferably only slightly greater than the width of the base of the thread. The ribs (3) are preferably angled across the core section (2) at the thread pitch.

The ribs (3) are preferably spaced on opposite sides of the core section (2) with an offset spacing of at least one thread pitch. A conventional hot rolled thread is formed by male ribs which extend from the core of the elongate member and these ribs may or may not be discontinuous around the circumference of the elongate member (1). These ribs (3) are formed, by rolls, on opposite sides of the elongate member (1) as it passes through a rolling stand in a rolling mill. For current hot rolled threaded elongate members, a rib is formed at every thread pitch on each side of the elongate member (1).

FIG. 1 shows ribs (3) directly opposite each other on opposed sides of the elongate member (1). It must be realised, however, that the present invention is not to be considered to be limited to such a thread form or configuration and the rib segments could be located at any position on the elongate member (1) provided they form part of the is thread profile, as shown in FIGS. 6, 8, 9, 11, 12, 14 and 19.

In an especially preferred embodiment, as shown in FIG. 2, ribs (3) may be offset along opposed sides of the elongate member (1) such that a rib (3) on one side of the elongate member (1) is directly opposite to a gap (4) on the other side of the elongate member (1). Such a preferred embodiment ensures that a maximum number of ribs may be engaged by a nut or the like member which is screwed onto such a hot rolled thread form.

As an example, for a hot rolled threaded elongate member approximately 25 mm in diameter, a hot rolled rib may typically be 5 mm wide at its base and 2.5 mm wide at its crest and be spaced every 15 mm along the elongate member. That is, the pitch of such a conventionally threaded elongate member will be 15 mm. The ribs are angled across the elongate member such they will align with the ribs on the opposite side of the elongate member so that the ribs form segments of a substantially continuous spiral or thread. These ribs may or may not be continuous around the circumference of the elongate member. Conventional threaded elongate members, and in particular hot rolled threaded elongate members, always have aligned ribs on opposite sides of the elongate member spaced at every thread pitch.

The present invention in an especially preferred embodiment provides for a hot rolled elongate member which does not have ribs spaced at every thread pitch along a elongate member. For example, if the base of the rib is approximately 4 mm wide, then the rib is angled across the elongate member such that the thread pitch is slightly greater than this, for example, 5 mm. However, the spacing of the ribs along the elongate member is some multiple of the thread pitch. The spacing of the ribs along the elongate member may therefore be 10 mm, 15 mm, 20 mm etc. The ribs therefore form discontinuous segments of a continuous thread profile.

Figure 16:
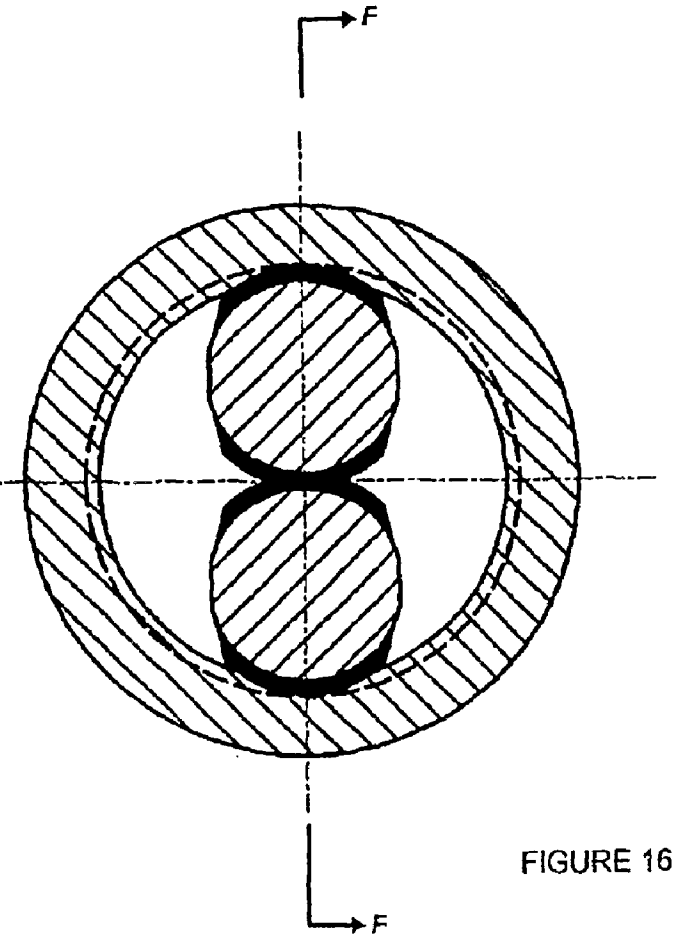
FIG. 16 is a cross section through section E—E shown in FIG. 15 of two hot rolled threaded members which are assembled together and are screwed inside a circular coupler which encloses and locates the two members.
Figure 15:
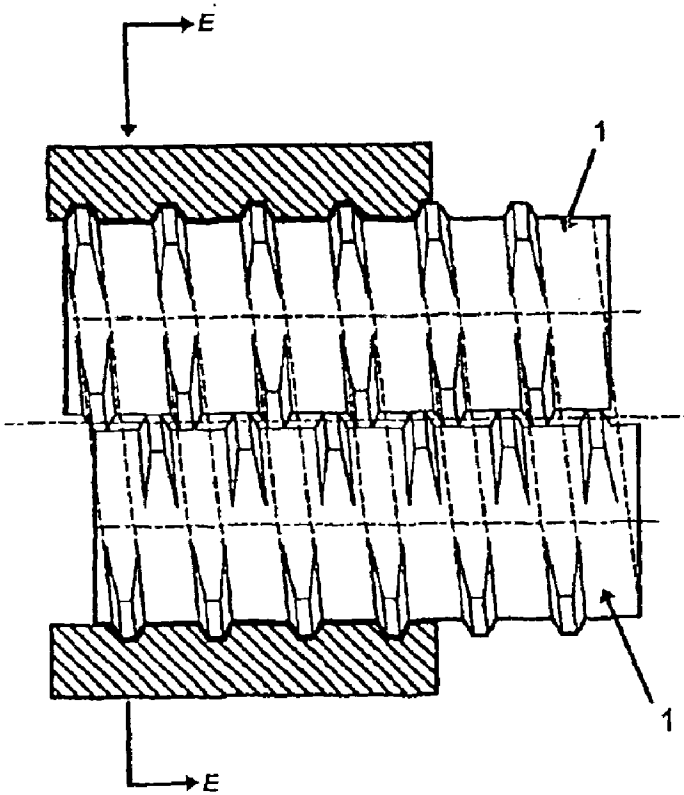
FIG. 15 is an enlarged side view of the thread detail of two hot rolled threaded members in accordance with the present invention, where the two members are assembled together with their long axes parallel and with the outer ribs on the two members aligned such that these outer ribs form discontinuous segments of a thread spiral or helix about a cylinder which encloses the two members.
Figure 17:
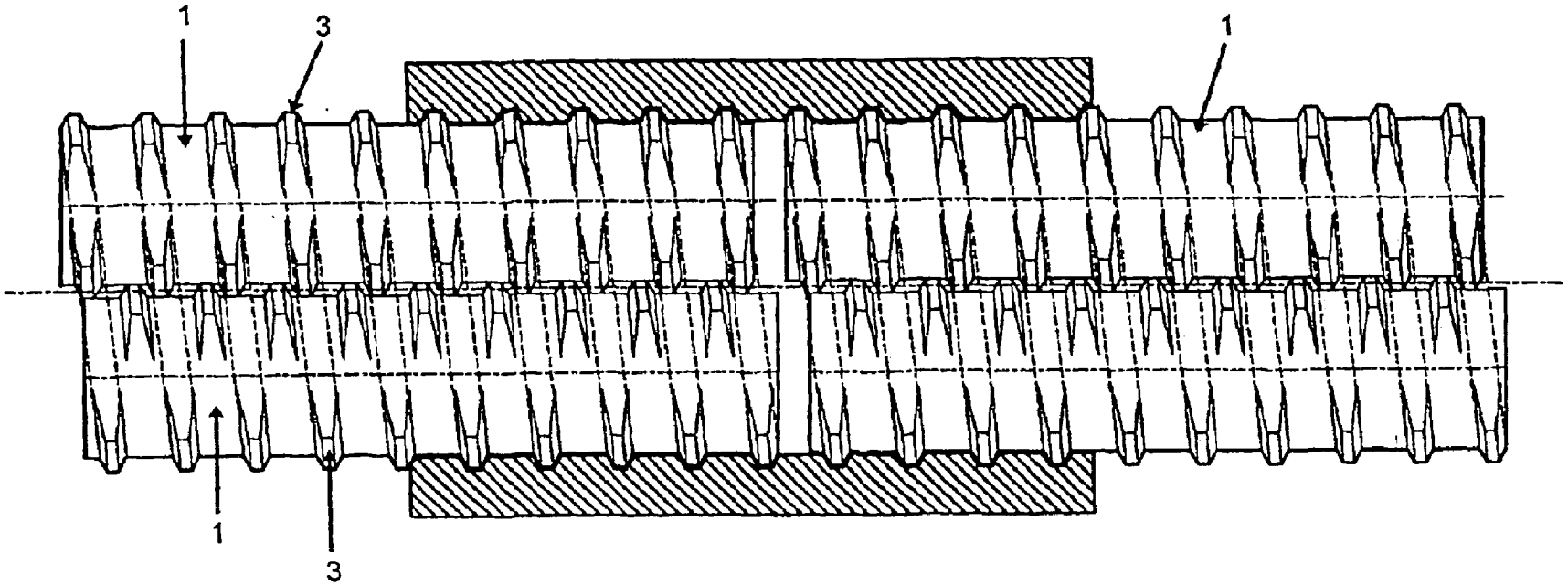
FIG. 17 is a view similar to FIG. 15, except that this Figure shows an enlarged side view of the thread detail of four hot rolled threaded members in accordance with the present invention, where two pairs of members are joined together with a coupler.
Figure 18:
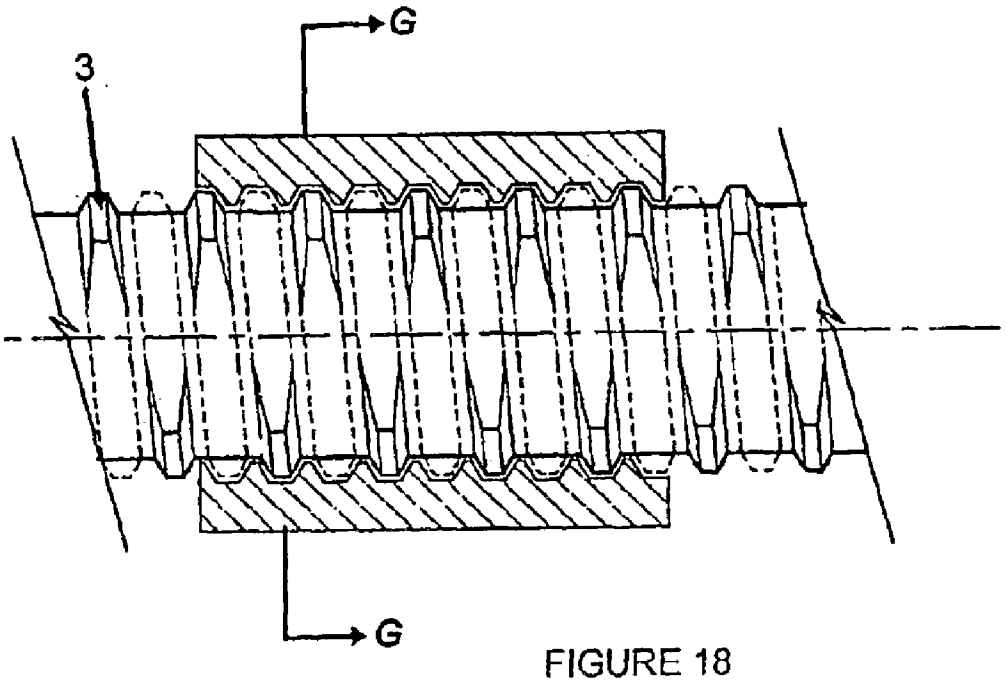
FIG. 18 is an enlarged side view of the thread detail of a hot rolled threaded member in accordance with the present invention, where a nut is screwed onto the member, FIG. 18 also shows that the rib spacing on the member is twice the pitch, whereas the sectional view of the groove spacing in the nut occurs at every thread pitch.
Figure 19:
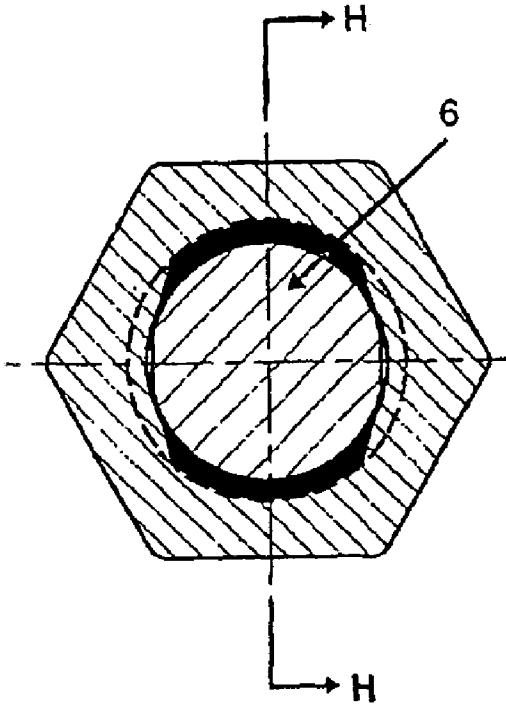
FIG. 19 is a cross-section through section G—G shown in FIG. 18 of a nut screwed onto the hot rolled threaded member.

The present invention, as shown in FIGS. 15 to 17, allows for two or more bars or elongate members in accordance with the invention to be placed together such that their longitudinal axes are parallel. If the two bars are then aligned correctly in their axial direction, it is possible to form a thread spiral or helix around the cylinder that encloses the two bars. The ribs on the individual bars form discontinuous segments that fit within that thread spiral or helix. It is therefore possible to screw a nut or a coupler around the outside of the two assembled bars.

It should be noted that this is not possible with conventional thread forms, which have the rib spacing equal to the pitch or the lead of the thread form. Note that in this specification the pitch or the lead is taken to mean the distance advanced in an axial direction in one complete turn about the cylindrical surface.

By way of example, consider a nominal 24 mm diameter bar with a conventional M24 metric thread on the outside of it. This thread would have a pitch of 3 mm and the pitch diameter would be approximately 22 mm. Therefore, the circumferential distance around the pitch diameter is approximately 69.1 mm.

The thread helix therefore advances axially 3 mm in a distance of 69.1 mm and has an angle of inclination or lead angle of approximately 2.48 degrees.

If two nominal 24 mm diameter bars-are placed side by side, both with M24 threads on them, the pitch diameter of a circle describing the two bars, is now approximately 45.5 mm. Therefore, the circumferential distance around the pitch diameter of the two bars together is 142.9 mm. Since the rib spacing is still the same at 3 mm, then the angle of inclination of the thread is 1.20 degrees which is almost exactly half the angle of inclination of a thread on a single bar with an M24 thread if the angle of inclination of a thread in a nut with a pitch diameter of 45.5 mm is adjusted to be equal to the angle of inclination of an M24 thread, i.e. 2.48 degrees, then the rib spacing of the thread in the nut increases to approximately 6 mm.

Therefore, two or more conventionally threaded bars assembled together axially, will not form a thread spiral or helix about a cylinder that encloses the two bars. It is therefore impossible to screw a nut or a coupler around the outside of two conventionally threaded bars.

However, with the new thread form, in accordance with the present invention it is possible to screw a nut or a coupler around the outside of two or more assembled bars as described hereinafter below.

For example, an individual threaded bar, with the thread form of the present invention on it, can be assembled together with another identical bar. It is possible to assemble these two bars together with their longitudinal axes parallel. Where the two assembled bars contact each other, the ribs on each bar interlock with each other, and their relative axial position can be adjusted slightly such that the ribs on the outside of the two bars that are not interlocked with each other, form discontinuous segments of a thread spiral or helix.

For example, if the individual threaded bar with the new thread form of the present invention has a nominal diameter of 20 mm and with a rib spacing of 10 mm with a pitch of 5 mm, the circumference of the thread is approximately 62.8 mm, and the angle of inclination of the thread is approximately 4.55 degrees, i.e. a 5 mm axial movement in a distance of 62.8 mm.

When two bars are-assembled together, the larger assembled bar will have a nominal diameter of 40 mm. The circumference of a circle describing the larger assembled bar will be 125.7 mm. Therefore, in order to keep the angle of inclination of the thread the same on the larger assembled bar as on the smaller individual bars, i.e. 4.55 degrees, then the rib spacing must be 10 mm. However, the rib spacing on the smaller individual bars is 10 mm, not 5 mm.

Therefore, two individual bars assembled together will form a thread spiral or helix on their outside surface provided that the rib spacing is twice the pitch. Note that the larger assembled bar could be made up from two or more individual smaller bars provided an external cylinder enclosing the assembled bars has a nominal diameter which is the same multiple of the diameter of individual bars as the multiple of the rib spacing to the thread pitch on the individual bars.

For example, if the rib spacing on a 20 mm diameter bar is 15 mm with a pitch of 5 mm, then the larger assembled bar must have a nominal diameter of 60 mm. A nominal 60 mm diameter assembled bar could be made up of any number of smaller 20 mm diameter bars providing that they still fit within a nominal 60 mm diameter cylinder enclosing the smaller bars.

In this context, nominal or approximate measurements and angles, are to allow for rib heights, thread clearances and variations in rolling and machining tolerances.

Advantages

The advantages of such an assembled bar made up of solid threaded bars are considerable.

Firstly, a very high capacity assembled and coupled rock bolt can be made using a bar that would be normally be used for single rock bolts, thus eliminating the requirement to roll a large diameter solid bar to obtain high capacity.

Secondly, it is possible to grout through the coupler or the nut, thus eliminating current difficulties of using separate grout tubes. The grout in the coupler or nut subsequently assists to join the bars together.

Thirdly, the individual bars can have their threads aligned in a jig in the factory and then be tack-welded together at their ends to simply form a larger assembled bar. Nuts and couplers can then be screwed onto them as required in the field. For example, if the tensile capacity of an individual bar is 30 tonnes, then two assembled bars would provide a tensile capacity of 60 tonnes and three assembled bars would provide a tensile capacity of 90 tonnes.

In addition, the assembled solid bars would interlock where they contact each other. Also, since the "groove" spacing in the female thread in the nut or coupler is still twice the pitch, the length of the nut or coupler required is less than would be required with a conventional thread.

Moreover, where multiple smaller bars are assembled together to make a large diameter assembled bar, one of the smaller bars can be a tube or pipe to assist in pumping grout up the hole. Also, grout can not only be pumped through the couplers and nuts, thus reducing the hole diameter that would otherwise be required, but it will also firmly lock the bars in the couplers and nuts when it has cured.

Finally, since the assembled bar is made up of individual bars with a threaded profile, the load transfer capacity of the assembled bar will be higher than can be achieved with a cable bolt.

Those skilled in the art will appreciate that the invention described herein is susceptible to variations and modifications other than those specifically described. It is to be understood that the invention includes all such variations and modifications. The invention also includes all of the steps, features, compositions, and compounds referred to or indicated in this specification (unless specifically excluded) individually or collectively, and any and all combinations of any two or more of said steps or features.

Throughout this specification, unless the context-requires otherwise, the word "comprise", or variations such as "comprises" or "comprising" will be understood to imply the inclusion of a stated integer or group of integers, but not to the exclusion of any other integer or group of integers.

Where the specification refers to a "rib" or to a "groove" or to a "thread" or to a "thread profile" or to a "hot rolled thread" it is to be understood that the invention includes all such variations and modifications of the above, and any other single or multiple thread element that could be used to provide a thread form that would provide a thread pitch less than the rib spacing on a threaded elongate member.

Where the specification refers to a "rib" it is to be understood that the invention includes all such variations and modifications of a "rib" but is not limited to these alone and includes one or many "ribs", "threads", or "profiles".

Where the specification refers to a "spiral" or to a "helix" or to a "screw" or to a "thread" it is to be understood that the invention includes all such variations and modifications of the above.

Where the specification refers to the "pitch" or to the "thread pitch" or to the "lead" it is to be understood that the invention refers to the distance a nut will move forward on the thread or the screw if it is rotated one full revolution.

It is to be understood that the aforegoing description refers to preferred embodiments of the present invention, and that variations and modifications will be possible thereto without departing from the spirit and scope of the invention, the ambit of which is to be determined from the following claims.

What is claimed is:

1. A process for the formation of a thread form in a substantially elongate member, wherein said elongate member and said thread form are formed by a hot rolling process and wherein said thread form includes at least one rib spaced apart from at least one other rib at a distance of greater than one thread pitch along said elongate member.

2. The process as claimed in claim 1, wherein the spacing between said ribs in the axial direction of said elongate member is a multiple of the thread pitch which is greater than one.

3. The process as claimed in claim 2, wherein said spacing between said ribs in said axial direction is between two and five times the thread pitch.

4. The process as claimed in claim 3, wherein said ribs on said elongate member form discontinuous segments of a thread spiral or thread helix.

5. The process as claimed in claim 4, wherein said ribs on each side of said elongate member are offset from each other by at least one thread pitch.

6. The process as claimed in claim 5, wherein the pitch of the thread of said thread form is substantially the same as the width of the base of said ribs.

7. The process as claimed in claim 6, wherein said base of said rib has a small radius at the location where it joins the core of said elongate member.

8. The process as claimed in claim 7, wherein the sides of said rib extending away from said core of said elongate member are inclined at an angle of approximately 60 degrees to the longitudinal axis of said core of said elongate member.

9. An elongate member including a thread form made according to the process of claim 1.

10. An assemblage of elongated threaded members according to claim 9 which, when assembled together, form a larger diameter elongate member with a thread spiral or helix around a cylinder enclosing said assembled members.

11. An assemblage according to claim 10, wherein the diameter of the larger assembled elongate member is a multiple of the diameter of the individual elongate members in the same ratio that the rib spacing is a multiple of the pitch on the individual elongate members.

* * * * *